US005153651A

United States Patent [19]

Kurotaka

[11] Patent Number: 5,153,651

[45] Date of Patent: Oct. 6, 1992

[54] MONOCOLOR/MULTICOLOR IMAGE FORMING EQUIPMENT WITH HIGH/LOW SPEED CONTROL

[75] Inventor: Shigeo Kurotaka, Sagamihara, Japan

[73] Assignee: Ricoh Company, Ltd., Tokyo, Japan

[21] Appl. No.: 761,479

[22] Filed: Sep. 18, 1991

[30] Foreign Application Priority Data

Sep. 18, 1990 [JP] Japan ..... 2-248486

[51] Int. Cl.[5] ..... G03G 15/14

[52] U.S. Cl. ..... 355/271; 346/157; 355/308; 355/326

[58] Field of Search ..... 355/202, 208, 210, 271, 355/272, 317, 326, 327, 308, 309; 346/157; 118/645

[56] References Cited

U.S. PATENT DOCUMENTS 4,723,146 2/1988 Kashara ..... 355/326

5,010,372 4/1991 Kasahara et al. ..... 355/327 X

*Primary Examiner*—A. T. Grimley

*Assistant Examiner*—William J. Royer

*Attorney, Agent, or Firm*—Oblon, Spivak, McClelland, Maier & Neustadt

[57] ABSTRACT

Image forming equipment selectively operable in a monocolor print mode or a multicolor print mode and capable of melting and mixing developers, or toners, of different colors sufficiently. The equipment has an image carrier, an intermediate transfer element and a medium transporting device each of which is driven at a particular speed depending on the print mode.

3 Claims, 4 Drawing Sheets

MONOCOLOR/MULTICOLOR IMAGE FORMING EQUIPMENT WITH HIGH/LOW SPEED CONTROL

BACKGROUND OF THE INVENTION

The present invention relates to a printer or similar image forming equipment selectively operable in a monocolor print mode or a multicolor print mode.

Conventional image forming equipment includes a printer which incorporates a plurality of developing units each storing a toner or similar developer of a particular color so as to form a desired monocolor or multicolor image. With this type of image forming equipment, it is a common practice to produce, for example, a multicolor image by transferring toners of different colors superposed one above another to a recording medium and then melt and thereby fix them on the medium. Such a procedure is successful in rendering an image in bright colors. A color OHP of the kind dealing with multicolor images has to melt and mix the toners of different colors sufficiently in a uniform distribution by a fixing unit, so that the transmittance and the gloss of a recording medium may be enhanced. The fixing unit, therefore, needs an amount of heat great enough to melt a transparent color toner or color toners of different colors sufficiently. Assuming a black-and-white image and a color image, the acceptable range of fixing heat differs from a black toner to color toners and from a monocolor print mode which uses only a black toner or a toner of any other color to a multicolor print mode which transfers toners of different colors lying one above another.

To change the amount of fixing heat, the fixing unit may have the pressure to be exerted by a fixing roller thereof, the fixing temperature, the fixing speed or similar factor thereof changed. However, changing the fixing pressure is not practicable without resorting to a special pressure changing mechanism which adds to the cost. Moreover, a high pressure and a high torque are needed when it comes to a multicolor image. Changing the fixing temperature is disadvantageous in that when the temperature is changed, the operator has to simply wait until the temperature reaches a predetermined one, resulting in poor operability. By contrast, changing the fixing speed is free from such drawbacks, and this scheme is disclosed in, for example, Japanese Patent Publications 22226/1984 and 1746/1986, Japanese Patent Laid-Open Publication No. 188673/1984, an Japanese Utility Model Laid-Open Publication No. 192158/1984.

The fixing speed may be changed depending on the operation mode, i.e., a monocolor print mode or a multicolor print mode, as taught in some of the above-mentioned documents. A problem with this scheme is that two or more processing speeds are necessary in order to render the speed of the entire equipment variable and, therefore, processing conditions cannot be set with ease. Moreover, in a multicolor print mode, the printing speed is lowered. Alternatively, the fixing speed may be changed after the transfer of an image, with the processing speed maintained constant. A prerequisite with this approach is that a recording medium be present between an image transfer position and a nip position defined in the fixing unit, i.e., the distance which a recording medium is to travel from the transfer position to the fixing unit be greater than the length of the medium. This increases the overall size of the equipment.

As discussed above, none of the conventional approaches of the kind changing the fixing speed is fully satisfactory.

SUMMARY OF THE INVENTION

It is, therefore, an object of the present invention to provide image forming equipment operable in a monocolor and a multicolor print mode and capable of sufficiently melting and mixing toners of different colors.

It is another object of the present invention to provide image forming equipment which makes a transport path between a fixing position and a fixing unit sufficiently shorter than the length of a recording medium, thereby achieving a miniature and compact construction.

In accordance with the present invention, image forming equipment selectively operable in a monocolor or a multicolor print mode comprises an image carrier for electrostatically forming a latent image thereon, a developing device for developing the latent image to produce a monocolor or a multicolor visible image, a medium transporting device for transporting a recording medium to which the visible image is to be transferred, and a controller for controlling the image carrier and medium transporting device. In a monocolor print mode, the image carrier and medium transporting device are each driven at a predetermined high speed. In a multicolor print mode, the image carrier is switched from the high speed to a low speed after all colors of the visible image have been developed on the image carrier, the medium transporting device transports the recording medium at a predetermined low speed, and the image carrier is switched from the low speed to the high speed after the transfer of the visible image.

Also, in accordance with the present invention, an image forming equipment selectively operable in a monocolor or a multicolor print mode comprises an image carrier for electrostatically forming a latent image thereon, a developing device for developing the latent image to produce a visible image, an intermediate transfer element to which the visible image is to be transferred, and a controller for controlling the image carrier, developing device and intermediate transfer element. In a monocolor print mode, the image carrier and intermediate transfer element are each driven at a predetermined high speed. In a multicolor print mode, the intermediate transfer element is switched from the high speed to a predetermined low speed after the transfer of the visible image to the intermediate transfer element, and the intermediate transfer element is switched from the low speed to the high speed after the transfer of the visible image to a recording medium.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1A:
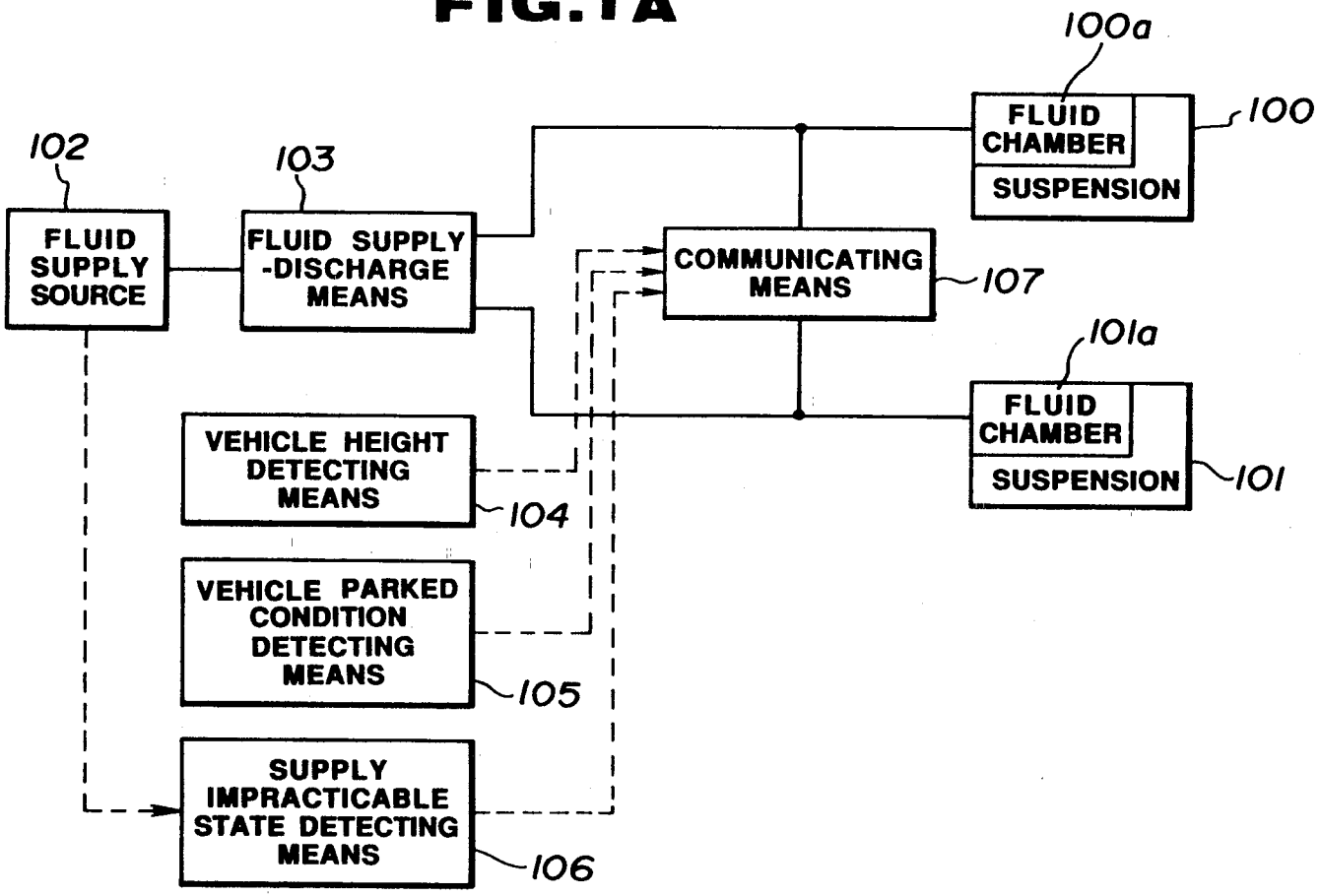
FIG. 1 is a section showing image forming equipment embodying the present invention.
Figure 1B:
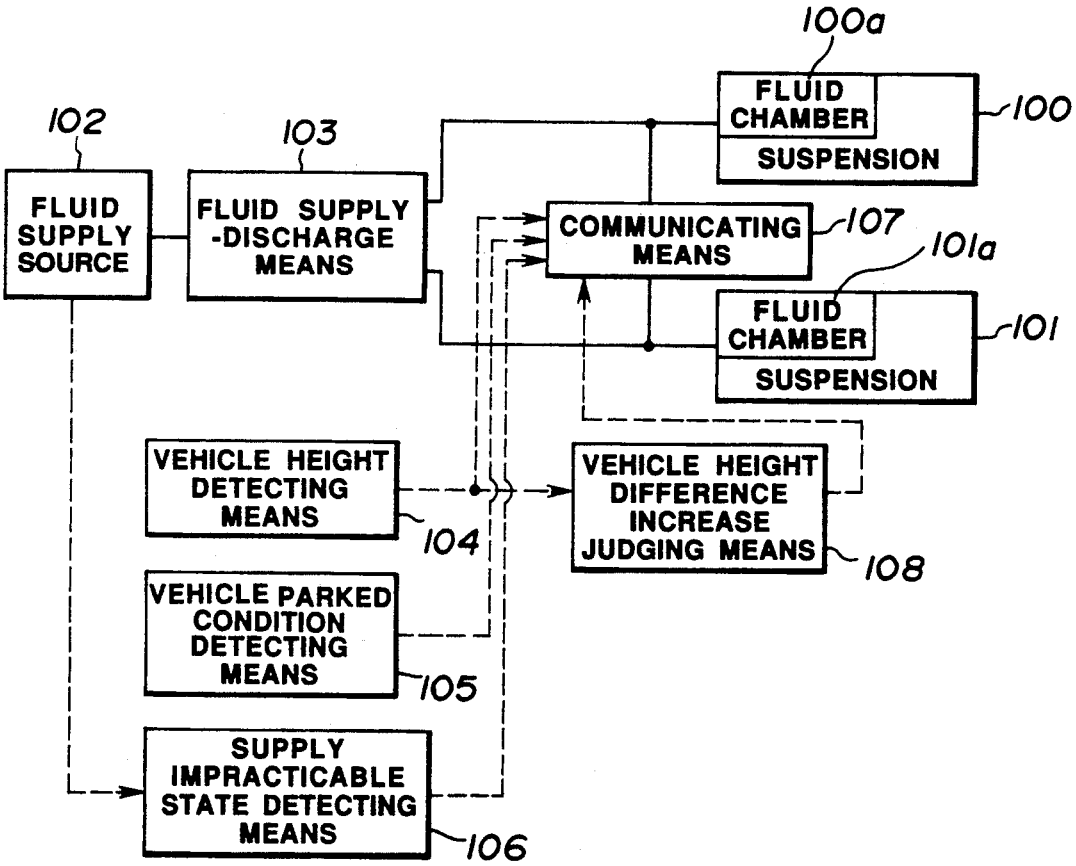

Referring to FIG. 1 of the drawings, image forming equipment embodying the present invention is shown and implemented as a printer. As shown, the printer, generally 1, has an image carrier in the form of a photoconductive drum 2, and a main charger 3 for uniformly charging the surface of the drum 2. As a writing device 4 exposes the charged surface of the drum 2 imagewise, a latent image is electrostatically formed on the drum 2. A developing device 5 has a plurality of developing units 5*y*, 5*m*, 5*c* and 5*bk* each accomodating a developer of particular color, e.g., yellow (Y), magenta (M), cyan (C) or black (BK). A toner image of particular color is formed on the drum 2 while the drum 2 is rotated once, i.e., predetermined toner images are sequentially formed while the drum 2 is rotated a predetermined number of times. For example, black, yellow, magenta and cyan toner images may be formed in this order to enhance the brightness of the resulting multicolor image. In both of a monocolor and a multicolor print mode, the drum 2 is rotated at a high speed $V_1$ adapted for a monocolor mode.

In a monocolor print mode, a paper sheet or similar recording medium 7 is fed from a cassette 6 by a pick-up roller 8 to a register roller pair 9. The register roller pair 9 drives the recording medium 7 in synchronism with the position of the drum 2 where an image is formed and at a high linear speed, e.g., 100 millimeters per second which is the same as the linear speed of the drum 2. A transfer charger 10 transfers a monocolor visible image such as a toner image from the drum 2 to the recording medium 7. The medium 7 carrying the visible image thereon is transported to a fixing device 11 and has the image fixed thereon at the same speed. A discharge roller pair 12 drives the medium 7 with the fixed image out of the printer to a tray 13. After the image transfer, the charge remaining on the drum 2 is dissipated by a discharger 14, and then the surface of the drum 2 is cleaned by a cleaner 15. The procedure described above is repeated thereafter.

Figure 2:
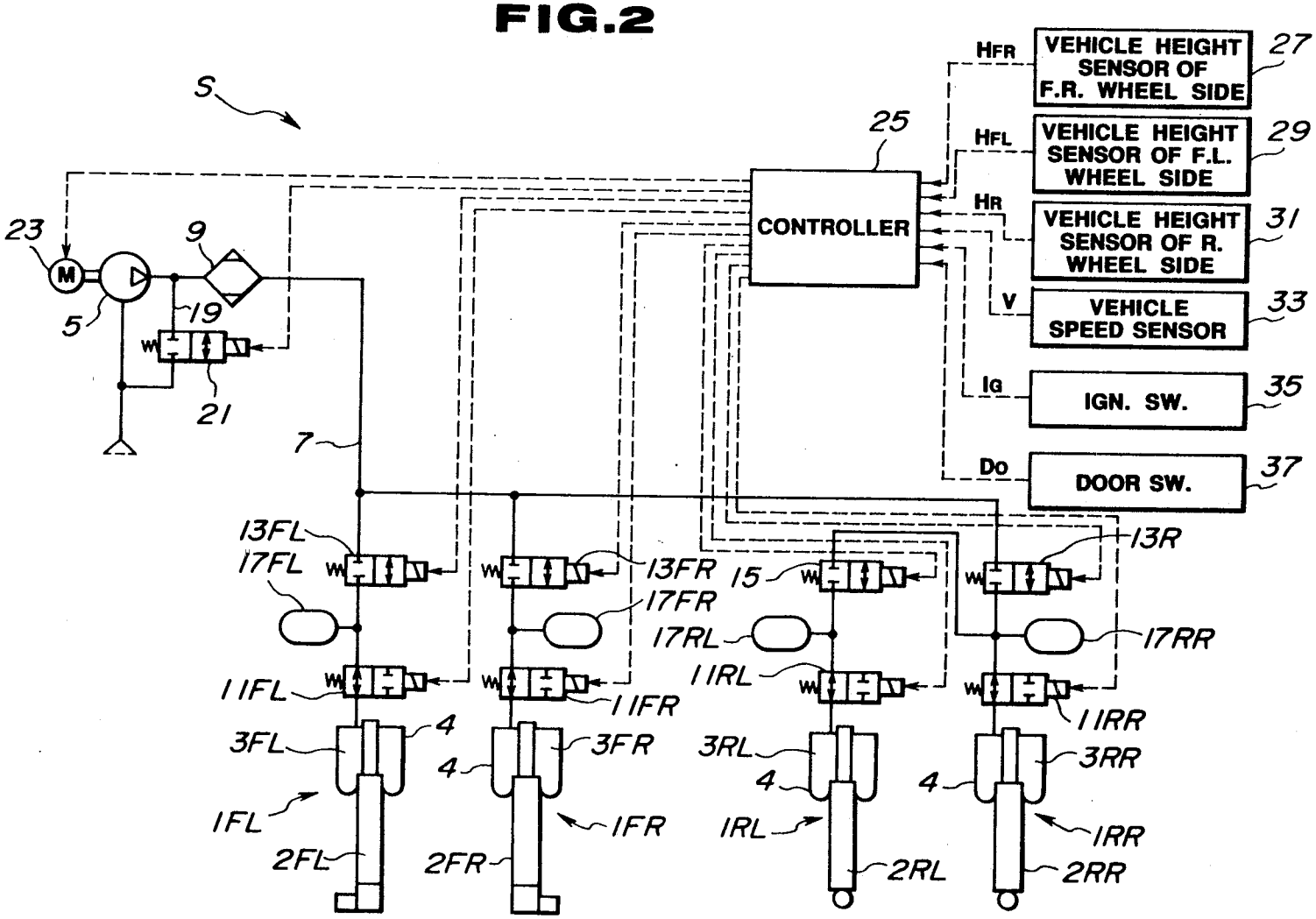
FIG. 2 is a timing chart demonstrating a specific operation of the embodiment.

As shown in FIG. 2, in a multicolor print mode, the drum 2 is rotated at the high speed $V_1$ as in the monocolor print mode and charged by the main charger 3. While the drum 2 rotates once, a black (BK) image is written by the writing device 4 and then developed by the black toner. While the drum 2 rotates another rotation, a yellow (Y) image is written and then developed by a yellow toner. Such a procedure is repeated with each of a magenta (M) image and a cyan (C) image also, every time the drum 1 rotates once. As soon as the image area representative of the cyan image, or last image, moves away from the main charger 3, the charger 3 is turned off to end the writing operation. When the resulting latent image is developed by the cyan toner, the rotation speed of the drum 2 is switched from the high speed $V_1$ to a low speed $V_2$ adapted for a multicolor mode. At this instant, the register roller pair 9 drives the recording medium 7 at a low transport speed, e.g., 50 millimeters per second. The transfer charger 10 transfers the multicolor visible image from the drum 2 to the recording medium 7. As the medium 7 moves away from the transfer position, i.e., as the image transfer ends, the drum 2 is switched from the low speed $V_2$ to the high speed $V_1$ to form another image thereon. The medium 7 carrying the image thereon is routed through the fixing unit 11 to the tray 13 at a low speed. The cleaner 15 cleans the drum 2 after the image transfer, as stated earlier.

While the recording medium 7 is fed in the above-described manner, a feed clutch and a register clutch, not shown, are turned on and off at the specific timings shown in FIG. 2 so as to control the rotation of the pick-up roller 8 and register roller pair 9. The pick-up roller 8 and register roller pair 9 constitute medium transporting means in combination. Since a plurality of toner images are formed one above another on the drum 2, the developing device 5 should preferably be implemented with a noncontact type developing system. The speeds of the drum 2 and register roller pair 9 may be switched over by changing the speed of a motor, not shown, associated therewith. Alternatively, clutches may be used to change such speeds, i.e., the amounts of deceleration.

Figure 3:
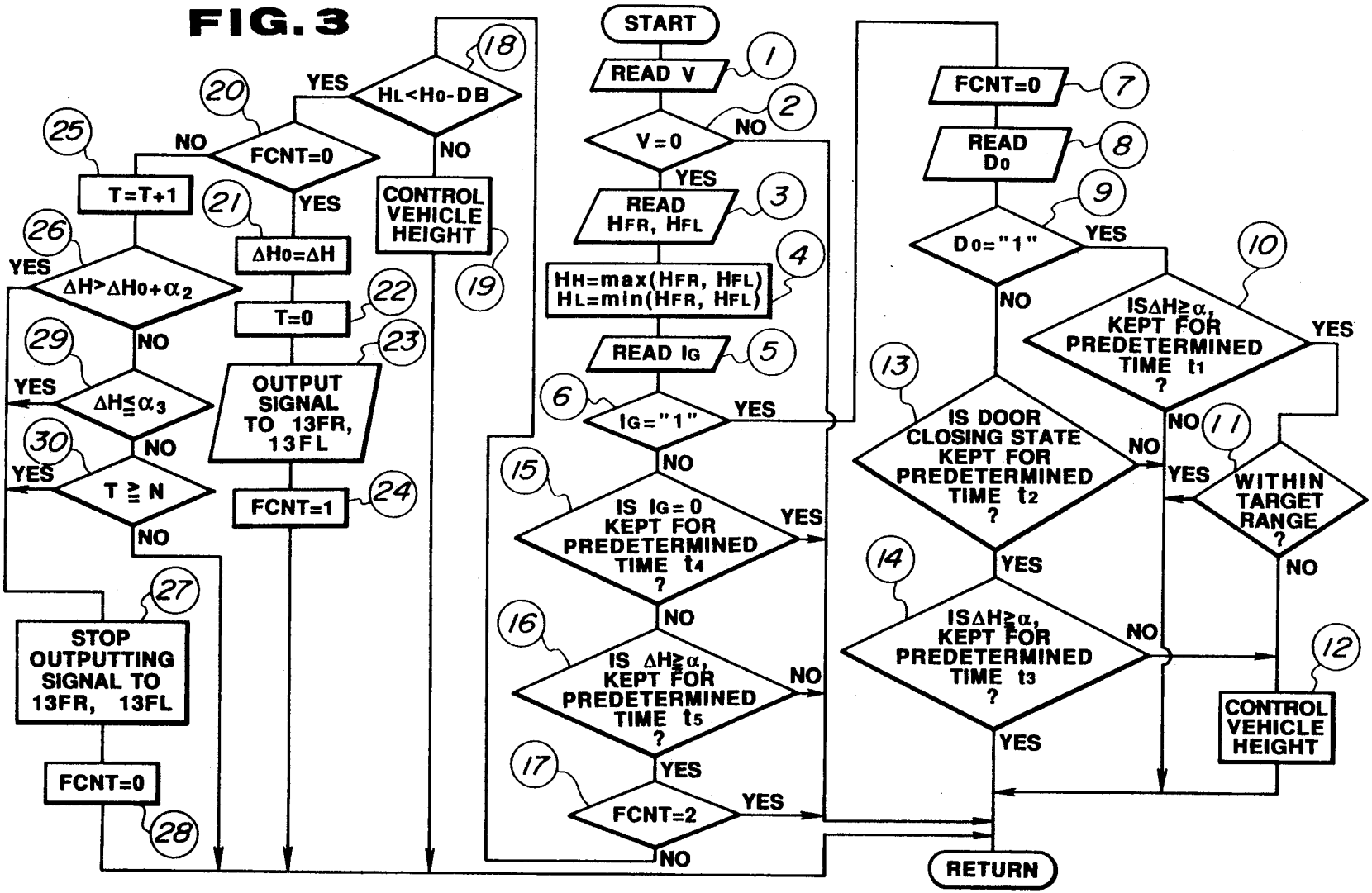
FIG. 3 is a section showing an alternative embodiment of the present invention.

Referring to FIG. 3, an alternative embodiment of the present invention will be described. In the figures, the same or similar components are designated by like reference numerals, and redundant description will be avoided for simplicity. In this embodiment, every time a printer 1' forms a toner image of particular color on the drum 2, it immediately transfers the toner image to an intermediate transfer element 16 by an intermediate transfer unit 17. After toner images of different colors have been sequentially transferred to the intermediate transfer element 16 one above another, the resulting multicolor image is transferred to the recording medium 7 by the transfer charger 10. Thereafter, the image is fixed on the recording medium 7 by the fixing device 12.

In this particular embodiment, the drum 2 is driven at a high speed in both of a monocolor and a multicolor print mode. In a multicolor print mode, the intermediate transfer element 16 is switched over to a low speed after all the toner images have been transferred from the drum 2 to the element 16. The resulting multicolor image is transferred from the element 16 to the medium 7 being transported at a low speed. After the transfer of the image from the element 16 to the medium 7, the element 16 is again driven at a high speed. In a multicolor print mode, the medium 7 is continuously driven at the low speed from the instant when it begins to be driven by the register roller pair 9 to the instant when it is driven out via the fixing device 12. In the illustrative embodiment, only the intermediate transfer element 16 and the medium transporting means made up of the pick-up roller 8 and register roller pair 9 are selectively rotatable at a high speed or a low speed.

An arrangement may be made such that a visible image is directly transferred from the drum 2 to the recording medium 7 wrapped around the intermediate transfer element 16, if necessary. While developing units 5Y, 5M, 5C and 5BK are shown in FIG. 3 as being arranged side by side, they may be implemented as the developing device 5, FIG. 1, incorporating the developing units 5*y*, 5*m*, 5*c* and 5*bk* therein.

In summary, it will be seen that the present invention provides image forming equipment capable of fixing, in a multicolor print mode, a color image on a recording medium at a low speed and, therefore, fixing the color image sufficiently on the medium. Specifically, a photoconductive element in the form of a drum or an intermediate transfer element has the speed thereof switched over, so that an image may be transferred to a recording medium at a low speed. Hence, the recording medium is transported and has the image fixed thereon at a low speed. In addition, since the drum and intermediate transfer element are each driven at a high speed after image transfer, high speed processing is achievable even in a multicolor print mode. Further, the equipment of the invention is small size since the transport path between a position where an image is to be transferred to a recording medium and a fixing position is reduced.

Various modifications will become possible for those skilled in the art after receiving the teachings of the present disclosure without departing from the scope thereof.

What is claimed is:

1. Image forming equipment selectively operable in a monocolor or a multicolor print mode, comprising:

an image carrier for electrostatically forming a latent image thereon;

developing means for developing said latent image to produce a monocolor visible image on said image carrier in the monocolor print mode or a multicolor visible image on said image carrier in the multicolor print mode;

medium transporting means for transporting a recording medium to which said visible image is to be transferred; and control means for controlling said image carrier and said medium transporting means such that in the monocolor print mode said image carrier and said medium transporting means are each driven at a predetermined high speed while, in the multicolor print mode, said image carrier is driven continuously at said high speed until all colors of said multicolor visible image are developed on said image carrier, and wherein said image carrier is switched from said high speed to a low speed after all colors of said multicolor visible image are developed on said image carrier to transfer said multicolor visible image to the recording medium, said medium transporting means transporting said recording medium at a predetermined low speed, and said image carrier being switched from said low speed to said high speed after the transfer of said visible image.

2. Image forming equipment selectively operable in a monocolor or a multicolor print mode, comprising:

an image carrier for electrostatically forming a latent image thereon;

developing means for developing said latent image to produce a visible image;

an intermediate transfer element having a surface contactable with said image carrier to transfer said visible image from said image carrier to said surface, said surface in turn being contactable with a recording medium to transfer said visible image from said surface to said recording medium; and control means for controlling said image carrier, said developing means and said intermediate transfer element such that in a monocolor print mode said image carrier and said intermediate transfer element are each driven at a predetermined high speed while, in a multicolor print mode, said intermediate transfer element is switched from said high speed to a predetermined low speed after the transfer of said visible image to said intermediate transfer element, and said intermediate transfer element is switched from said low speed to said high speed after the transfer of said visible image to said recording medium.

3. Image forming equipment selectively operable in a monocolor or a multicolor print mode, comprising:

an image carrier for electrostatically forming a latent image thereon;

developing means for developing said latent image to produce a visible image;

an intermediate transfer element to which said visible image is to be transferred;

control means for controlling said image carrier, said developing means and said intermediate transfer element such that in a monocolor print mode said image carrier and said intermediate transfer element are each driven at a predetermined high speed while, in a multicolor print mode, said intermediate transfer element is switched from said high speed to a predetermined low speed after the transfer of said visible image to said intermediate transfer element, and said intermediate transfer element is switched from said low speed to said high speed after the transfer of said visible image to a recording medium;

medium transporting means for transporting said recording medium;

said control means controlling said intermediate transfer element and said medium transporting means such that in a monocolor print mode said intermediate transfer element and said medium transporting means are each driven at a predetermined high speed while, in a multicolor print mode, said intermediate transfer element is switched from said high speed to a predetermined low speed after the transfer of said visible image to said intermediate transfer element and then switched to said high speed after the transfer of said visible image to said recording medium, and said medium transporting means is driven at a predetermined low speed.

* * * * *